US007013017B2

(12) United States Patent
Pavlovic

(10) Patent No.: US 7,013,017 B2
(45) Date of Patent: Mar. 14, 2006

(54) MICROPHONE CAPSULE SUPPORT

(75) Inventor: Gino Pavlovic, Vienna (AT)

(73) Assignee: AKG Acoustics GmbH, Vienna (AT)

( * ) Notice: Subject to any disclaimer, the term of this patent is extended or adjusted under 35 U.S.C. 154(b) by 321 days.

(21) Appl. No.: 10/127,023

(22) Filed: Apr. 19, 2002

(65) Prior Publication Data

US 2004/0151335 A1 Aug. 5, 2004

(30) Foreign Application Priority Data

Apr. 24, 2001 (AT) ..... A 658/2001

(51) Int. Cl.
*H04R 25/00* (2006.01)

(52) U.S. Cl. ..... 381/369; 381/355; 381/360; 381/361

(58) Field of Classification Search ..... 381/355, 381/358, 360–362, 368–369, 386, 388, 392, 381/395, 189; 181/198–199
See application file for complete search history.

(56) References Cited

U.S. PATENT DOCUMENTS 3,653,625 A * 4/1972 Plice ..... 267/113
4,453,045 A * 6/1984 Bruna ..... 381/354
6,128,393 A * 10/2000 Kondo ..... 381/368
6,226,386 B1 * 5/2001 Akino ..... 381/173

* cited by examiner

*Primary Examiner*—Suhan Ni
(74) *Attorney, Agent, or Firm*—Friedrich Kueffner

(57) ABSTRACT

A microphone capsule support in which the microphone capsule is mounted elastically in a microphone housing using two annular diaphragms. The capsule is connected through the annular diaphragms to a bearing bushing and a cover is connected to the bearing bushing at least in an essentially air-tight manner, such that a closed volume is formed by the lower annular diaphragm, the cover and the capsule. A small opening is provided for connecting the closed volume to the atmosphere. The bearing bushing and/or the cover are connected to the microphone housing.

4 Claims, 3 Drawing Sheets

MICROPHONE CAPSULE SUPPORT

BACKGROUND OF THE INVENTION

1. Field of the Invention

The present invention relates to a microphone capsule support which is mounted in the microphone housing and serves as an elastic suspension of the microphone capsule which is mounted in the microphone.

2. Description of the Related Art

Independently of the manner of operation of the microphone capsule, hereinafter called capsule in short, it is necessary in all microphones to mechanically connect the capsule to the microphone housing, on the one hand, and, on the other hand, to acoustically insulate and separate the capsule from the gripping noises. For solving these two opposite objects, so-called elastic rubber bearings are known in the art. These rubber bearings are collar-shaped or spider-shaped structures made of an elastic rubber or a rubber-like material into which the capsule is embedded and which is glued or clamped in the interior of the microphone housing or is permanently or separably connected in some other manner to the microphone housing Since all microphone capsules are sound pressure transducers, two basic problems have to be confronted: the microphone capsule is not capable of distinguishing between useful sound and undesirable shaking movements of the microphone capsule. Both types of excitation have the same effect: the diaphragm of the microphone capsule is moved which consequently results in an electrical signal at the microphone output. It is apparent that an electrical signal which is generated by shaking the microphone is not desirable. Therefore, microphone manufacturers attempt to use structural measures for keeping the shaking or gripping noises as small as possible.

In the mechanical system, the microphone capsule and the elastic suspension or elastic support can be considered a mass/spring system. In the mechanical analysis of such systems, one arrives at the differential equations whose solutions constitute a complete description of the mechanical system. Since, considered formally, the above-mentioned differential equation of the mechanical resonant circuit (mass/spring damping) completely corresponds to a differential equation of the electrical resonant circuit (inductivity/capacity resistance), it is possible to carry out an analysis in the electrical domain by means of analogy computations.

In these computations, the mass m corresponds to the inductivity L, the spring c corresponds to the capacity C, and the damping k corresponds to the ohmic resistance R.

Since mechanical tools are easier to use for electrical engineering (computation with complex impedances), it is possible in this manner to more quickly obtain the result than would be the case when solving the mechanical basic equations. Subsequently, the results from the electrical domain are transformed into the mechanical domain, and the movements of the microphone are thus completely described with respect to time as well as with respect to frequency.

When answering the question as to how the mass/spring system should be adjusted so that the microphone reacts less sensitively to shaking or gripping noises, first the question concerning the limits of the transmission range of the microphone must be answered. Microphones are built for different purposes and, in dependence on this purpose, the lower and upper frequency limits are selected differently on a case by case basis. Generally, it can be stated that high-quality microphones have a wider frequency range, in the direction of lower frequencies as well as in the direction of higher frequencies, than is the case in microphones of lower quality. Since the excitation of the microphone capsule by shaking or gripping noises takes place in the low-frequency range, the lower frequency limit plays an important role for the behavior of a microphone in relation to the interference excitations transmitted by the microphone.

Expressed differently, if the frequency pattern of a microphone reaches to the lowest frequencies which are still perceptible by the human ear, its behavior relative to shaking or gripping noises will be much more sensitive than in a microphone whose lowest frequency limit still to be transmitted is adjusted at a higher level.

Consequently, it is possible to make a microphone less sensitive to shaking and gripping noises by adjusting its lower limit frequency at a higher level. However, microphone capsules and microphones adjusted in this manner lose some of their audio quality.

Some microphone manufacturers mount additional electrical filters in the microphone. These are so-called step sound filters which are switched on when the microphone is mounted on a stage microphone stand and interference noises, for example, step noises, must be expected from the stage floor. The electrical filter is adjusted in such a way that low frequencies are cut off electrically. Since an electrical filter can also not distinguish between useful and interference signals, when the step sound filter is switched on, useful sound is also unintentionally weakened i dependence on the frequency in accordance with the filter characteristic. As a result, a good microphone becomes a microphone of lower quality.

The tendency of development in the prior art is the following: it is being attempted not to limit the transmission range of the microphone capsule in the lower frequency range and, for this purpose, to adjust the elastic support of the microphone capsule in such a way that the mechanical resonant frequency of the system composed of capsule and support is adjusted at such a low level that it is outside of the frequency range to be transmitted. This is easily possible in a microphone with a lower frequency limit of 200 Hz; however, in microphones of higher quality with a lower frequency limit of 20 Hz, this is substantially more difficult.

As is generally known from the above-mentioned analysis of the differential equations, in the immediate vicinity of the mechanical resonant frequency of a mechanical resonant system amplitudes occur which are substantially greater than the amplitudes of the excitation signal. In order to reduce this undesirable amplitude increase, rubber or rubber-materials are used for the support, wherein these materials provide a high degree of internal damping. These materials convert the mechanical energy supplied from the outside by shaking the microphone housing into heat.

These materials used fulfill their purpose in non-problematic surroundings in a satisfactory manner; however, even if these materials are used, there are a number of problems: materials with high resiliency are adjusted with high damping by adding various chemical and mechanical additives. This has the consequence that the material has a high temperature dependency of its mechanical properties (strength, elasticity) and, thus, reacts strongly to different climatic conditions. Thus, the supports known in the art for high-quality microphones lose their elasticity almost completely already at temperatures of slightly above 0° C., and they become hard, which leads to a completely ineffective capsule support.

On the other hand, the rubber support becomes so soft already at temperatures around 40° C. that there is the danger that the capsule sags through as a result of its own mass to such an extent that it contacts the inner side of the microphone housing which also leads to a completely ineffective capsule support.

However, not only the unsatisfactory temperature stability of the rubber supports constitutes a serious problem in the use of the support; aging is another serious problem. Rubber is attacked by ultraviolet light to a significant extent and, due to the unavoidable loss (due to evaporation) of so-called softeners (chemical additives which have the purpose of softening the rubber), the rubber becomes brittle and breakable.

SUMMARY OF THE INVENTION

Therefore, it is the primary object of the present invention to provide an elastic support for microphone capsules which does not have the above-mentioned and other negative properties of the supports of the prior art. Preferably, the support should also be adaptable in a simple manner to the respective type of capsule and the respective field of use.

In accordance with the present invention, the three elements of the mechanical resonant circuit, i.e., the mass m of the capsule, the springiness c of the support and the damping k of the support (corresponding in the electrical circuit to R, C and L) are formed as separate elements. Preferably, this is effected in the following manner:

The capsule L is fastened by means of two diaphragms. The diaphragms are made of materials which have no internal damping or only a very small internal attenuation. Consequently, they can be considered and treated as pure spring elements C. Since, contrary to the prior art, the diaphragms do not have any internal damping (and should have no internal damping), a significantly greater number of materials is available for the selection of the material of the diaphragm than is the case in the prior art.

In accordance with the invention, the damping element R is also formed as a separate structural element which also provides complete new possibilities for a solution.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
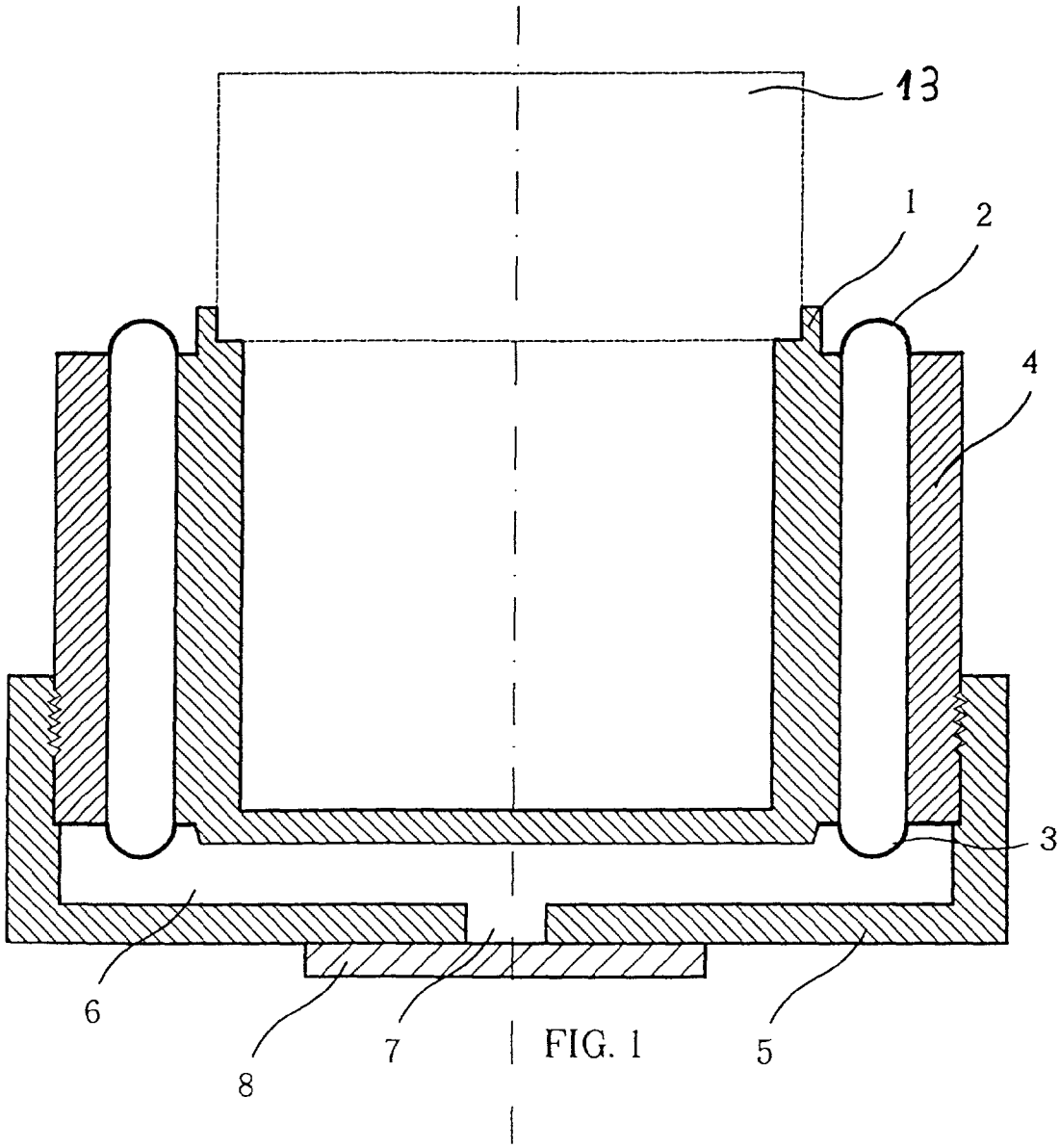
FIG. 1 is a sectional view of the capsule according to the present invention.

As illustrated in FIG. 1, a microphone capsule 1 is connected in accordance with the present invention by means of two annular diaphragms 2, 3 to a bearing bushing 4, preferably by gluing. As shown in thin or broken lines, the capsule 1 protrudes above the upper diaphragm 2, while the lower diaphragm 3 ends essentially flush with the bottom side of the capsule. In the illustrated embodiment, the portion 13 shown in broken lines corresponds to the actual capsule, while the portion shown in solid lines constitutes a volume necessary for the acoustic adjustment whose walls are immovably connected to the actual capsule, so that, within the framework of the present invention, the volume is still part of the capsule. Of course, if such a volume is not necessary it can also be omitted A cover 5 is screwed onto the lower end of the bearing bushing 4; the cover 5 is mounted at least essentially in an air-tight manner on the bearing bushing and is provided with at least one small opening 7. In this manner, the lower diaphragm 3 forms together with the cover 5 a closed volume 6 which is open towards the outside only through the small opening 7 in the cover 5. The opening 7 is preferably covered or filled out with a material 8 which is partially or poorly permeable to air.

The material 8 may be, for example, felt, PU-foam, non-woven fabric, a fabric of synthetic or natural fibers, or also a metal fabric. The fabric does not have to be a classic fabric produced by weaving, the fabric may also be a so-called non-woven tissue.

The mass of the microphone capsule 1 and the spring properties of the annular diaphragms 2, 3 form a mechanical resonant circuit whose resonant frequency is "selected" as described above and is adjusted by the selection of the material and the dimensions of the annular diaphragms 2, 3 (in special cases, also by placing a weight on the capsule 1). Materials to be used for the diaphragms 2 and 3 are especially PC-foil, aluminum, copper, steel or brass, each in the form of a foil and preferably with a thickness of 0.01 mm to 1 mm.

In order to limit the maximum amplitude of this mechanical resonant circuit, it is necessary to introduce into the resonant circuit a mechanical damping element, which in practice is a friction element.

This damping is achieved by the opening 7 together with the porous material 8 which is partially or poorly permeable to air. When an axially directed mechanical excitation of the microphone housing and, thus, the bearing bushing 4, occurs, the microphone capsule 1 is displaced from its position of rest and moves upwardly or downwardly depending on the type and direction of the excitation. As a result, the air is pushed out or suctioned out of the closed volume 6 through the opening 7 and the partially permeable material 8. Due to the flow properties of this passage, this causes substantial mechanical friction which dampens the movement of the air flowing through the passage and, thus, the movement of the capsule 1.

The assembly of these components in the respective device or housing takes place either through the bearing bushing 4 or the cover 5; in all cases, the assembly takes place in such a way that the movements of the microphone capsule 1 are not impeded.

Figure 2:
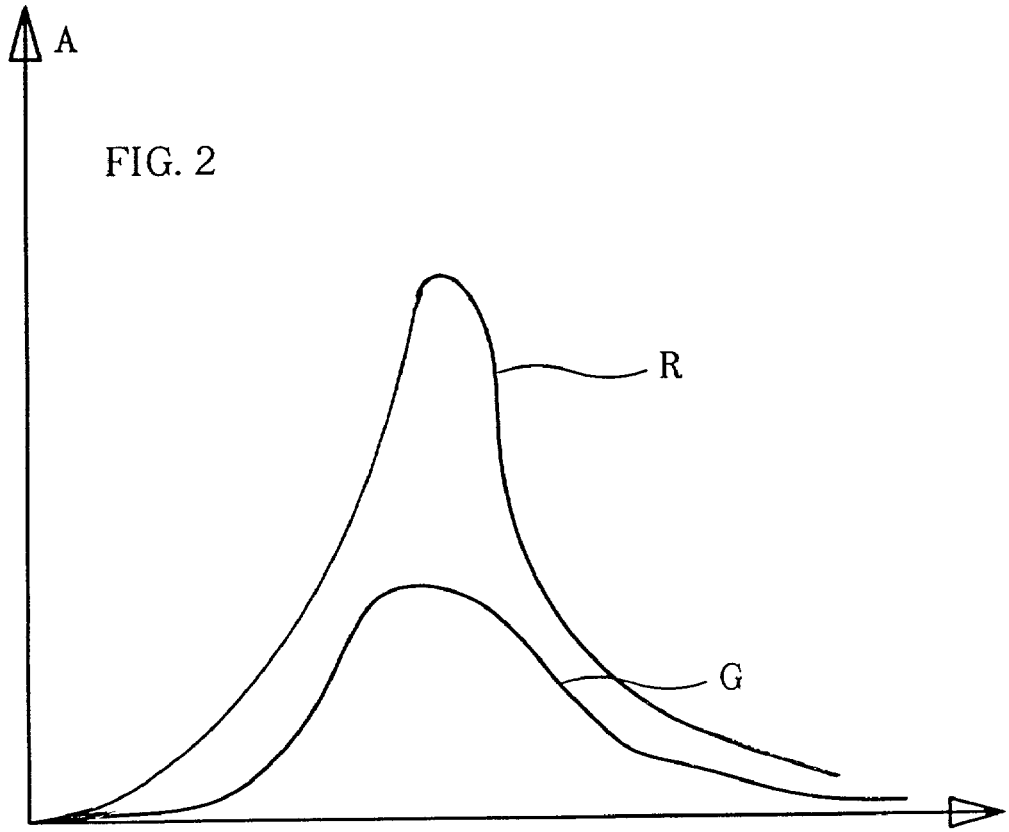
FIG. 2 is a diagram showing the frequency pattern of a capsule according to the present invention as compared to a capsule according to the prior art.

FIG. 2 shows examples for the pattern of the amplitude over the frequency achievable according to the present invention with different damping constants R, as they can be achieved, for example, by different materials A and/or different dimensions of the hole 7. The curve R shows the oscillation behavior in the case of small friction and the curve G shows the behavior in comparison with greater friction. As can be seen from FIG. 2, the oscillation behavior can be changed to a great extent by changing the friction value, without significantly changing the resonant frequency of the mechanical system.

The fact that the adjustment of the friction can be carried out independently of the adjustment of the spring force constitutes a substantial improvement of the support of the microphone capsule, because no compromises have to be made when selecting the material of the diaphragms and, vice versa, the friction value necessary for the adjustment of the support can be selected without unintentionally changing the spring characteristic of the support.

Figure 3:
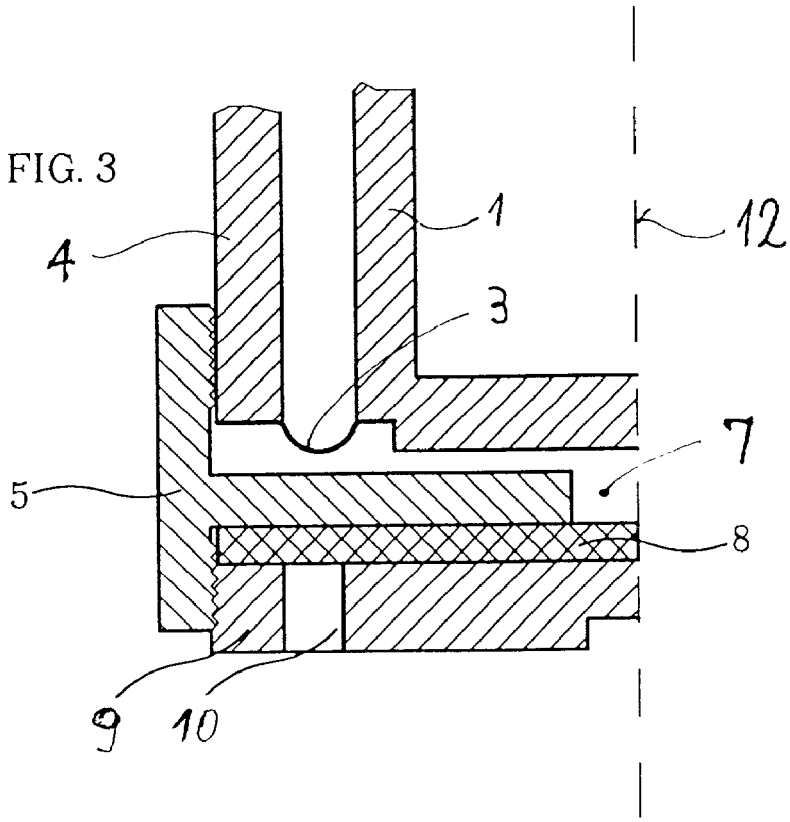
FIG. 3 is a partial sectional view of a further development of the invention.

FIG. 3 shows another possible embodiment of the friction element. In accordance with this embodiment, it is possible in a simple manner to carry out desired changes of the friction value. As shown in the drawing, this is made possible by providing the cover 5 on its side facing away from the capsule with a perforated disk 9 which has at least one through hole 10. Provided between the bottom surface of the cover 5 and the perforated disc 9 is a material 8 which is poorly permeable to air and which, in this embodiment, not only closes the opening 7 in the cover 5, but also essentially extends over the entire area between the cover 5 and the perforated disc 9. The perforated disc 9 is screwed onto the cover 5, so that the flow properties of the air passage formed by the small opening 7, the material 8 which is poorly permeable to air, and the hole or holes 10, can be changed by screwing the perforated disc 9 more or less tightly onto the cover 5. Consequently, it is possible to change the damping of the capsule support in a simple and infinitely variable manner and to adapt it to various uses and assembly situations.

Figure 4:
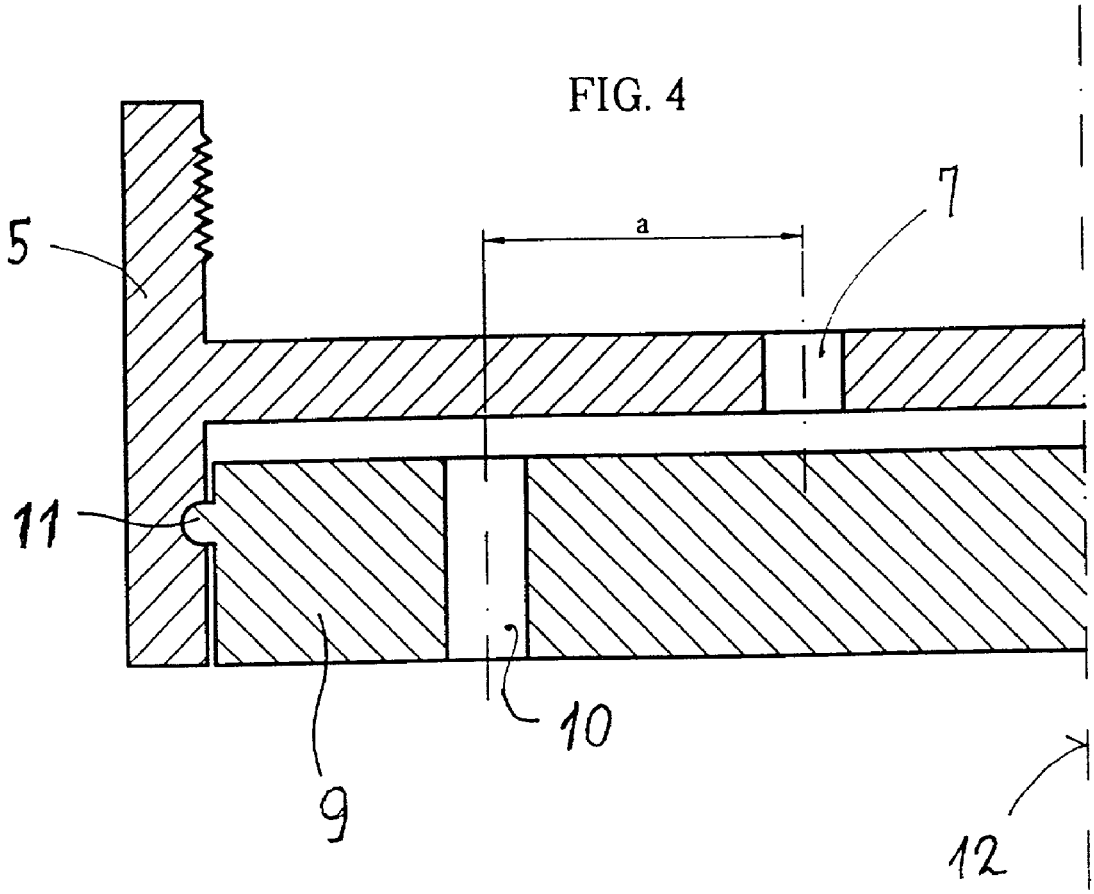
FIG. 4 is a partial sectional view of yet another further development of the invention.

Another possibility for adjustment is shown in FIG. 4. FIG. 4 only shows the cover 5 which has at least one eccentric opening 7. In this embodiment, there is no damping material between the cover 5 and the perforated disc 9. Of course, it would be possible to place such a damping material in the space between the cover 5 and the perforated disc 9. In the embodiment of FIG. 4, the threads which were required in the embodiment of FIG. 3 and which may be very expensive, can be omitted; in this embodiment, the perforated disc 9 can be rotated, for example, by means of a projection 11 which engages in a groove of the cover 5. Because of the eccentric location of the opening 7 or the hole 10 relative to the axis of rotation 12, it is possible by rotating the perforated disc 9 relative to the cover 12 to change the length a of the flow path of the oscillating air and, thus, also to change the friction and the damping of the oscillations of the capsule.

Of course, it is possible to combine and to change the various embodiments described above. The essential feature is that support of the capsule 1 is effected by means of two annular diaphragms 2 which do not have to have any special damping properties, and that the damping of the oscillations of the capsule takes place by the dampened flow of air into and out of a hollow space which is formed, on the one hand, by the capsule and, on the other hand, by the bearing bushing of the capsule and, finally, by one of the annular diaphragms.

Further developments concern, for example, the possibility of damping this flow of air by additional elements in a reproducible manner. Another development concerns the possibility of using the microphone housing in connection with the damping system according to the present invention for performing the acoustic adjustment of the transducer.

The invention is not limited by the embodiments described above which are presented as examples only but can be modified in various ways within the scope of protection defined by the appended patent claims.

I claim:

1. A microphone capsule support, comprising an upper and a lower annular diaphragm and a bearing bushing connected through the annular diaphragms to the capsule, a cover being connected to the bearing bushing at least in an essentially air-tight manner, such that a closed volume is formed by the lower diaphragm, the cover and the capsule, wherein the cover has an opening for connecting the closed volume to atmosphere, and wherein at least one of the bearing bushing and the cover is connected to a microphone housing, further comprising a perforated disc mounted on a side of the cover facing away from the capsule, wherein the perforated disc has at least one hole arranged in a non-aligned position with the opening, and wherein the perforated disk is connected to the cover through a threaded connection.

2. The microphone capsule support according to claim 1, comprising a material which is poorly permeable to air covering or filling out the opening.

3. The microphone capsule support according to claim 1, wherein a space between the cover and the perforated disc is filled with a material which is elastically compressible and poorly permeable to air.

4. The microphone capsule support according to claim 1, wherein at least one of the opening and the hole is located at a distance from a capsule axis, and wherein the perforated disc is rotatable relative to the cover.

* * * * *